United States Patent [19]

Niggemann

[11] Patent Number: 5,029,640

[45] Date of Patent: Jul. 9, 1991

[54] GAS-LIQUID IMPINGEMENT PLATE TYPE HEAT EXCHANGER

[75] Inventor: Richard E. Niggemann, Rockford, Ill.

[73] Assignee: Sundstrand Corporation, Rockford, Ill.

[21] Appl. No.: 345,777

[22] Filed: May 1, 1989

[51] Int. Cl.[5] ..... F28D 9/00

[52] U.S. Cl. ..... 165/164; 165/111; 165/908

[58] Field of Search ..... 165/111, 164, 166, 167, 165/908

[56] References Cited

U.S. PATENT DOCUMENTS

| | | | |
|---|---|---|---|
| 3,534,813 | 10/1970 | Fleming | 165/164 |
| 3,797,565 | 3/1974 | Fernandes | 165/111 |
| 4,156,459 | 5/1979 | Kusuda et al. | 165/167 |
| 4,315,300 | 2/1982 | Parmerlee et al. | 361/382 |
| 4,347,897 | 9/1982 | Sumitomo et al. | 165/167 |
| 4,494,171 | 1/1985 | Bland et al. | 361/386 |
| 4,621,685 | 11/1986 | Nozawa | 165/111 |
| 4,637,456 | 1/1987 | Niggemann | 165/104.33 |
| 4,643,250 | 2/1987 | Niggemann et al. | 165/159 |
| 4,690,210 | 9/1987 | Niggemann et al. | 165/159 |

FOREIGN PATENT DOCUMENTS

| | | | |
|---|---|---|---|
| 2706003 | 8/1977 | Fed. Rep. of Germany | 165/167 |
| 894869 | 1/1945 | France | 165/167 |
| 61-49995 | 3/1986 | Japan . | |

*Primary Examiner*—4
*Assistant Examiner*—Allen J. Flanigan
*Attorney, Agent, or Firm*—Wood, Phillips, Mason, Recktenwald & VanSanten

[57] ABSTRACT

The problem of designing an impingement plate type heat exchanger (10) for exchanging heat between a pair of fluids wherein one of the fluid is a gas, such as air, is solved by providing a stack of plates (12) including impingement orifice plates (14), spacer plates (16) and manifold plates (18, 20). The impingement orifice plates and the spacer plates cooperate to define first and second flow paths (F and E) generally parallel to each other and perpendicularly through the plates for the liquid and the gas, respectively. The first flow path (F) for the liquid is tortuous through orifices (56) of the plates. The manifold plates define flow passages (24) for distributing the liquid to the first tortuous flow path. The flow passages in the manifold plates extend generally parallel to the plates.

28 Claims, 6 Drawing Sheets

GAS-LIQUID IMPINGEMENT PLATE TYPE HEAT EXCHANGER

FIELD OF THE INVENTION

This invention generally relates to heat exchangers and, particularly, to a heat exchanger of the impingement plate type particularly adapted for exchanging heat between a gas and a liquid.

BACKGROUND OF THE INVENTION

In aerospace applications, there is a constant need for exchanging heat between two flowing fluids for a variety of needs, such as lubricant fluids, pump fluids, fuel fluids and the like. Often, one fluid is used to cool another. For instance, should a coolant be used to cool various components of an aircraft, fuel might be used to exchange heat with the coolant and thereby have a self-contained or on-board heat exchange circuit. Many heat exchangers used for such purposes are quite cumbersome in a field where size and weight are critical parameters.

In aircraft and aerospace environments, one of the most readily available heat sinks that could be used as a heat exchanger medium is the air itself. However, air has poor heat transfer coefficients when compared with liquids, such as fuel, hydraulic liquid or the like, and relatively large heat exchanger structures would be required if using an air heat exchange medium. Therefore, air substantially has been dismissed as a cooling medium because of the critical size and weight limitations in aircraft applications.

The need for and the advantages of providing a gas or air/liquid heat exchanger are obvious, if the problem of designing a small, lightweight heat exchanger structure could be met.

Heat exchangers using an impingement cooling principal are known for exchanging heat between different liquids flowing through the exchanger. Some heat exchangers that use the impingement cooling principal are of the impingement plate type. With such heat exchangers, liquid passes through a plurality of holes in a given plate and strikes a solid portion or "impinges" against a subsequent, usually parallel, plate where it moves along that plate to the nearest orifice and passes through the plate for impinging against a solid portion of the next plate. Eventually, after passing through a series of plates, the liquid leaves the heat exchanger. This impingement cooling principle aids in the heat transfer between the liquid and each plate. Of course, the holes or orifices in adjacent plates are misaligned intentionally so that the liquid must impinge against a subsequent plate prior to passing through the orifices thereof. This forces the liquid to impinge against each plate after passing through the previous plate to provide a tortuous path for the liquid rather than permitting the liquid merely to flow through holes in the stack of plates.

An example of an impingement cooling apparatus employing impingement orifice plates is shown in my U.S. Pat. No. 4,494,171, dated Jan. 15, 1985, and assigned to the assignee of this invention.

Most such impingement plate type heat exchangers are designed to exchange heat between liquids which are generally similar. However, this invention is directed to providing an improved impingement plate type heat exchanger using gas (air) as a cooling medium and thereby solving the problem of using that medium in heat exchanger applications in aircraft and aerospace environments where size and weight are critical parameters.

SUMMARY OF THE INVENTION

An object, therefore, of the invention is to provide a new and improved heat exchanger of the impingement plate type for using gas or air as one of the cooling mediums.

In the exemplary embodiment of the invention, an impingement plate type heat exchanger is disclosed in various embodiments for exchanging heat between a liquid and a gas. A stack of plates include impingement orifice plates, spacer plates and manifold plates. The impingement orifice plates and the spacer plates cooperate to define first and second tortuous flow paths generally parallel to each other and perpendicularly through the plates for the liquid and the gas, respectively. The manifold plates, at least in part, define flow passage means for distributing the liquid to the first tortuous flow path.

More particularly, the manifold plates have channel means defining the flow passage means for the liquid. The channel means extend generally parallel to the plates and open at a peripheral edge of the manifold plates to provide inlet means and outlet means for the liquid to the stack of plates. As disclosed, the inlet means and the outlet means are located along a common edge of the stack of plates, and a header means is located along that edge for directing liquid to and from the channel means. In addition, drain means are provided at an edge of the stack of plates remote from the liquid header for draining liquid, such as water, from the plates resulting from impingement of the air against the plates.

Various modifications for alternative constructions of a heat exchanger are illustrated herein using the above principles, including the use of at least a pair of stacks of plates oriented in a V-shaped configuration, with the air medium flowing into and around the V-shaped stacks. In addition, an embodiment illustrates the stack of plates in a cylindrical configuration, with the air again flowing in and around and through the cylindrical plates for exchanging heat with the liquid flowing through the plates.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE INVENTION

Figure 1:
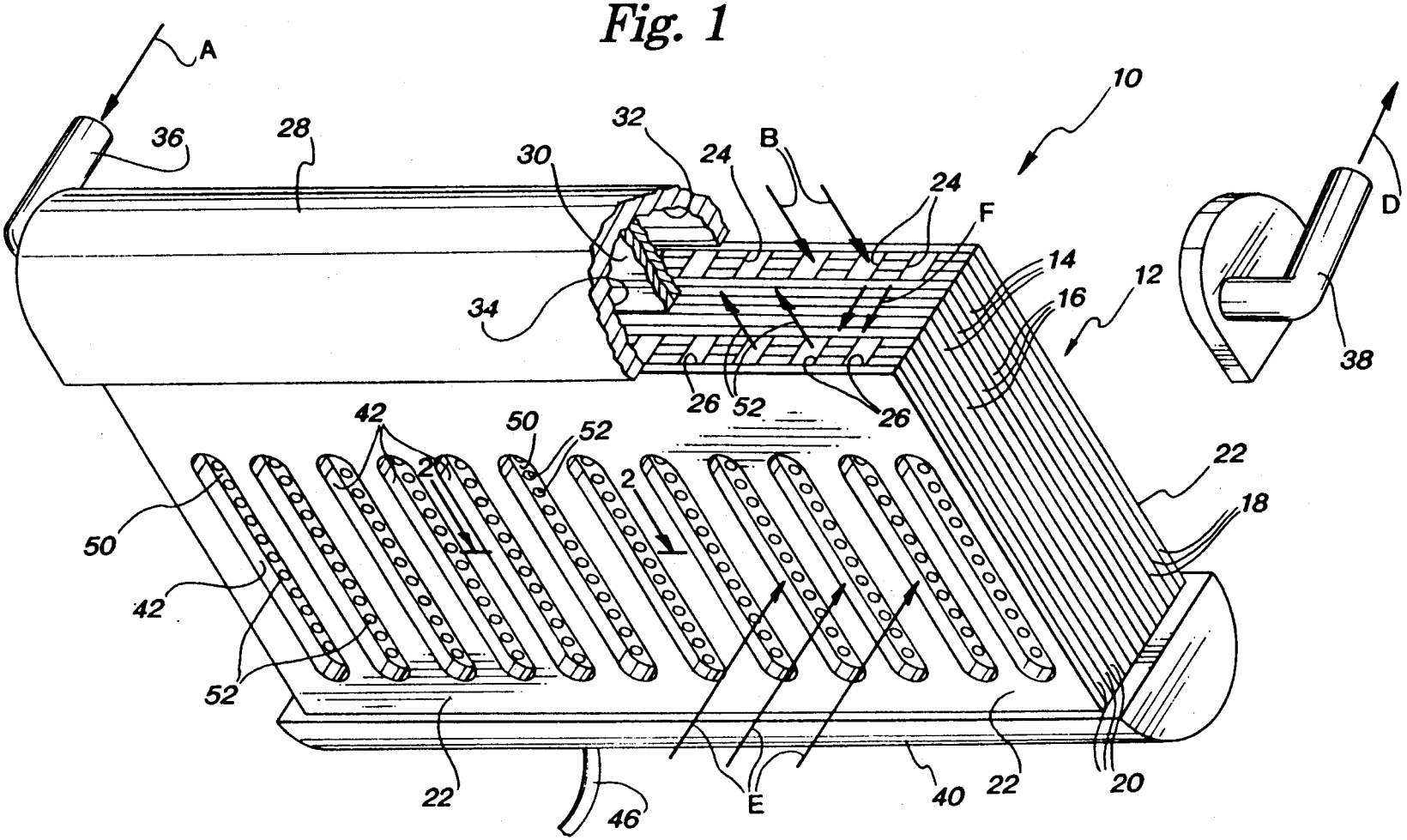
FIG. 1 is a perspective view, partially fragmented and exploded, illustrating one embodiment of the invention employing a stack of plates providing an impingement plate type heat exchanger for liquid and gaseous mediums.

Referring to the drawings in greater detail, and first to FIG. 1, an impingement plate type heat exchanger is provided for exchanging heat between a liquid (see arrows "A-D") and a gas such as air (see arrows "E"). Heat exchanger 10 includes a stack of plates, generally designated 12, which in turn includes a plurality of impingement orifice plates 14, spacer plates 16, manifold plates 18 and 20, and end plates 22. The internal configuration and cooperative function between these plates will be more apparent in relation to the description of FIG. 2, below.

However, FIG. 1 shows a plurality of flow passages 24 along one edge of the stack of plates 12 opening at the edge of manifold plates 18. Another series of flow passages 26 are located along the same edge of stack 12 and opening at the edge of manifold plates 20. As will be better understood below, liquid enters the stack of plates through flow passages 24 as indicated by arrows "B" and exit the stack of plates through flow passages 26 as indicated by arrows "C". A semi-cylindrical header 28 covers the edge of stack 12 at which flow passages 24 and 26 open. The header has a central partition 30 for dividing the interior thereof into flow passages 32 and 34. It can be seen that interior header passage 32 communicates with flow passages 24, and interior header passage 34 communicates with flow passages 26. An inlet 36 is provided at one end of header 28 in communication with interior flow passage 32, and an outlet 38 is provided at the opposite end of header 28 in communication with interior flow passage 34. Therefore, it can be understood that liquid is supplied to the heat exchanger 10 through inlet 36. The liquid then flows longitudinally within interior header flow passage 32 and is directed to flow passages 24 of manifold plates 18 which, as will be described hereinafter, distributes the liquid to impingement orifice plates 14. The liquid flows through the orifice plates generally perpendicularly therethrough as indicated by arrows "F" and exits the stack of plates through flow passages 26 in manifold plates 20 as indicated by arrows "C". The liquid then flows through internal header passage 34 to outlet 38 and out of the heat exchanger as indicated by arrow "D".

End plates 22 are provided with a plurality of elongated slots 42 through which air can be forced by any appropriate means through the stack of plates 12 in the direction of arrows "E". The plates have flow passages 44, shown somewhat schematically visible through slots 42, whereby the air flows through the stack of plates generally perpendicularly therethrough but opposite the flow of liquid through impingement plates 16 (as indicated by arrows "F").

From the foregoing, it can be seen that first and second flow paths as indicated by arrows "F" and "E", respectively, are provided generally parallel to each other and perpendicularly through the plates for the liquid and the gas, respectively, whereas manifold plates 18 and 20, at least in part, define flow passages 24 and 26, respectively, for distributing the liquid to impingement orifice plates 14. In essence, channel means are provided in manifold plates 18,20 defining flow passages for the liquid generally parallel to the plates and generally perpendicular to flow paths "E" and "F". Still further, as will be seen in FIG. 2, flow paths 24,26 for the liquid are offset relative to flow paths 42 (i.e. arrows "E") for the air.

Figure 1A:
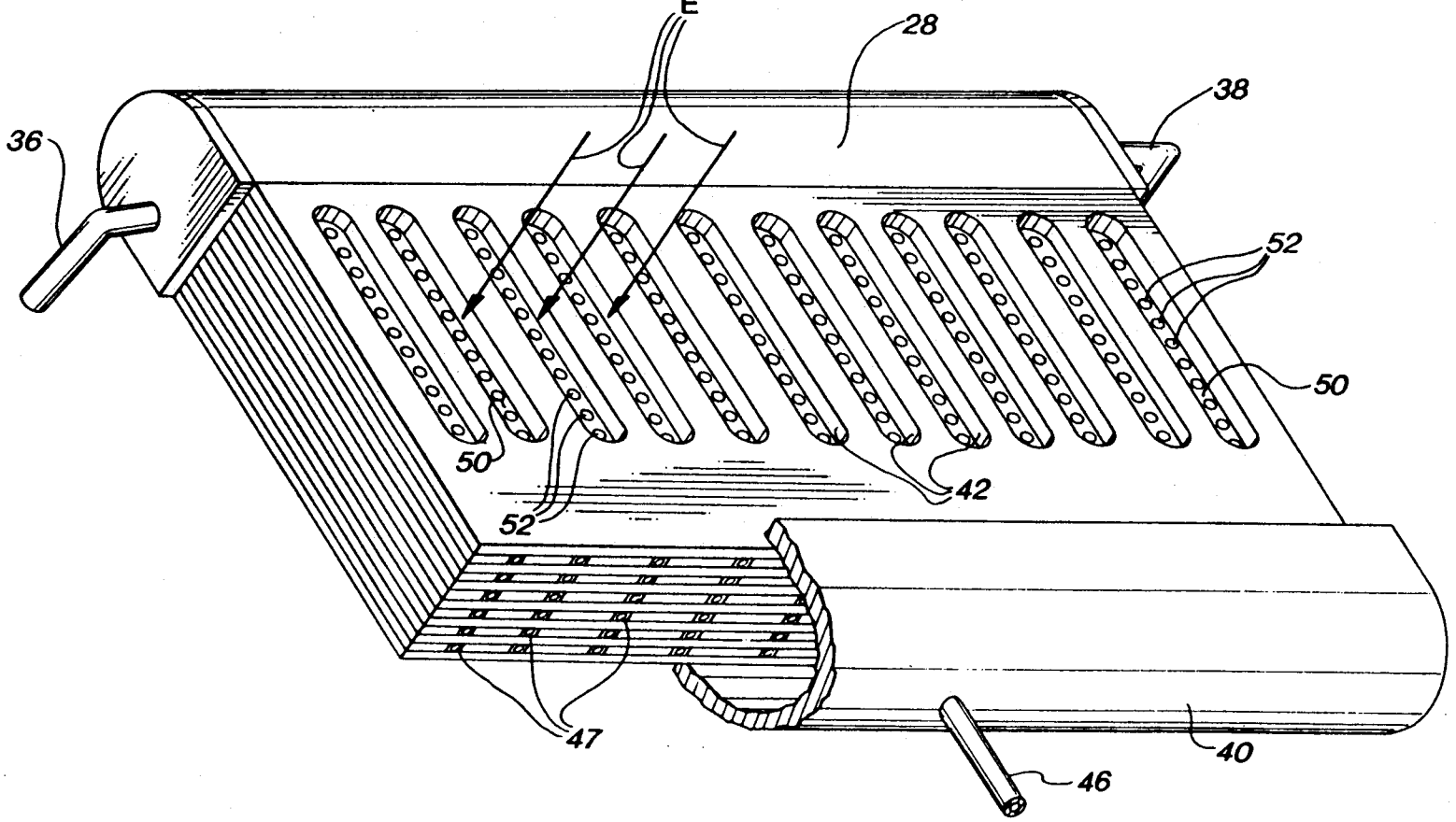
FIG. 1A is a perspective view, partially fragmented, looking toward the bottom of FIG. 1.

Lastly, as seen best in FIG. 1A, a drain 46 is provided in a lower header 40 for draining any liquid which might accumulate on the plates as a result of moisture in the air impinging on the plates As will be seen, the flow paths and manifold passages for the liquid are completely closed and contained within the stack of plates, but, depending upon the usage of the heat exchanger and the relative temperatures between the liquid and the gas, condensate can form on the plates from the air, whereby the condensate simply flows down the plates into header 40 and is drained therefrom through drain 46. To that end, drain holes 47 (FIG. 1A) are provided at the bottom of the stack for draining the condensate into lower header 40.

Figure 2:
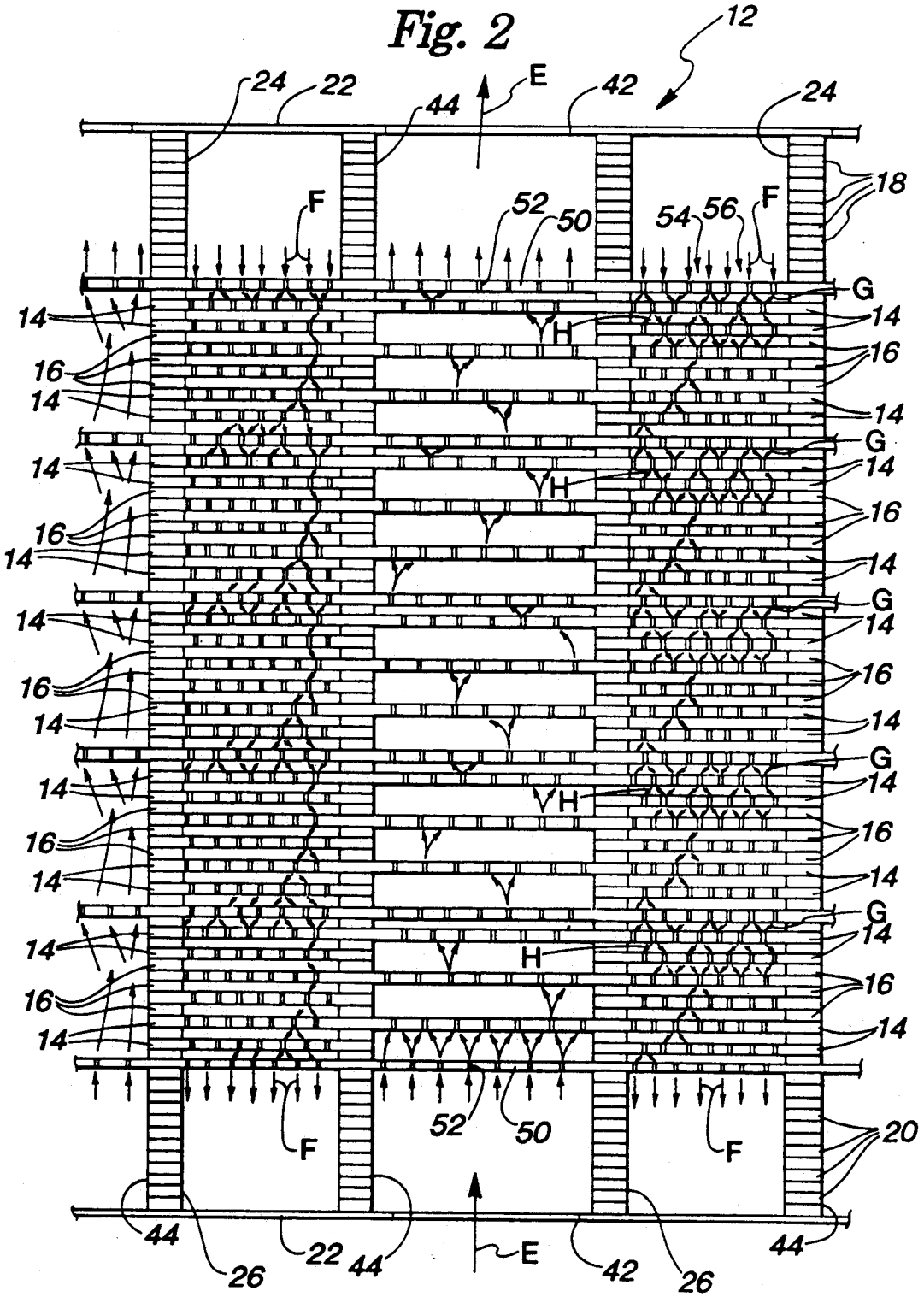
FIG. 2 is a fragmented, enlarged section taken generally along line 2—2 of FIG. 1, illustrating the flow paths and manifold passages through the stack of plates.

Turning now to FIG. 2, an enlarged section through a portion of the stack of plates 12 of heat exchanger 10 (FIG. 1) is shown to illustrate the internal construction and flow circuitry of the exchanger. Before proceeding, it should be noted that there are considerably more impingement orifice plates 14, spacer plates 16 and manifold plates 18 and 20 shown in FIG. 2 than in FIG. 1. This has been done to make FIG. 1 somewhat more clear, and also to show that the number of plates of each type can vary depending on the requirements or capacity of the heat exchanger. More particularly, end plates 22 with elongated slots 42 are shown for the flow of air through the stack of plates in the direction of arrows "E". Manifold plates 18 are shown defining flow passages 24, and manifold plates 20 are shown defining flow passages 26. Of course, since the direction of flow is generally parallel to the plates as indicated by arrows "B" and "C" in FIG. 1, no arrows can be shown for the flow in passages 24. However, it can be seen that the flow of air through the plates as indicated by arrows "E" is generally perpendicular to the plates, whereas the distribution of the liquid through passages 24,26 is generally parallel to the plates.

FIG. 2 also shows impingement orifice plates 14 and spacer plates 16 defining tortuous flow paths for the liquid from flow passages 24 to flow passages 26, generally perpendicularly through the orifice plates. Note arrows "F" in comparison to the same directional arrows shown in FIG. 1.

The impingement plate-type heat exchanging concept of the invention can be understood when it is seen that impingement orifice plates 14 and spacer plates 16 alternate in the stack thereof. Although not absolutely necessary, this stack of plates is sandwiched between a pair of heat exchange orifice plates 50. These orifice plates have orifices 52 located in the flow path (E) for the air to define a moderate degree of circuity for the air through the heat exchanger.

In essence, manifold plates 18,20 and spacer plates 16 define the boundaries of the flow paths through the heat exchanger.

As liquid passes through the orifice plates from flow passages or channels 24 to flow passages or channels 26, the liquid first passes through orifices 54 in the upper heat exchange orifice plate 50. After passing through orifices 54, as indicated by arrows "G", the liquid impinges upon solid portions of the first impingement orifice plate 14. After the liquid strikes or "impinges" against the solid portions of the first impingement orifice plate, the liquid moves along the plate to offset orifices 56 and passes through that plate for impingement upon the subsequent impingement orifice plate 14 as indicated by arrows "H". Once again, the impinging liquid moves along the subsequent plate and passes through the orifices therein and so on through the stack of orifice plates 14 and the lower heat exchange orifice plate 50. The orifices in adjacent orifice plates are misaligned intentionally so that the liquid must impinge against a subsequent plate prior to passing through the orifices of that plate, and so on through the orifice plates until the liquid enters flow passage or channel 26. The liquid then is directed back to header 28 (FIG. 1) as indicated by arrows "C" and out through the heat exchanger through interior header passage 34 and outlet 38. Lastly, any liquid accumulating on the interior walls or plates within flow passage 44 for the air simply will drain downwardly into header 40 and out drain 46.

Figure 3:
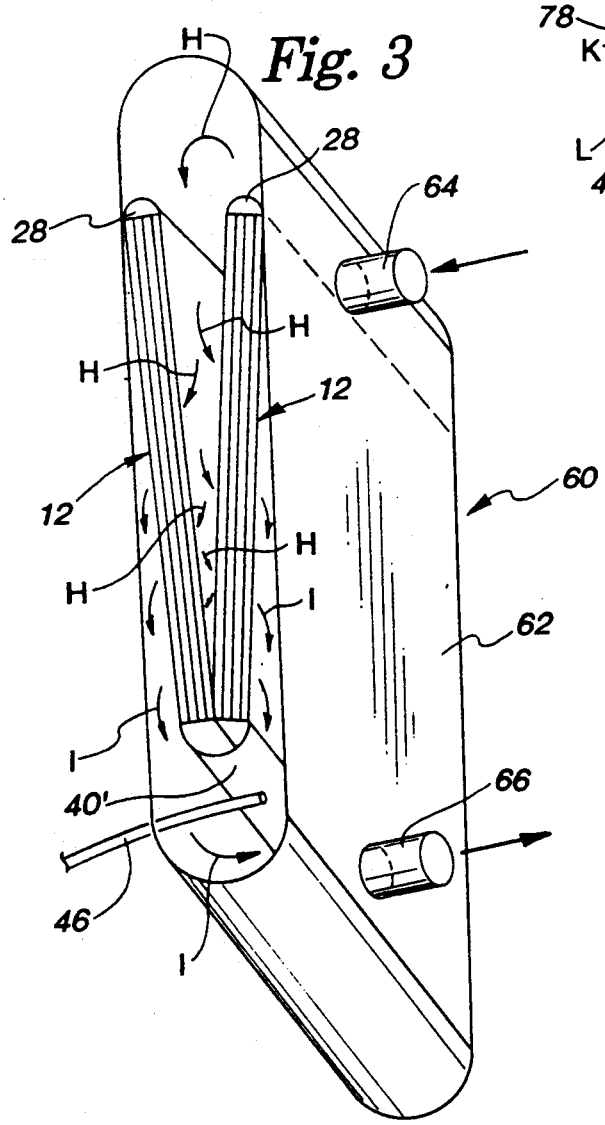
FIG. 3 is a somewhat schematic, perspective illustration of another embodiment using stacks of plates similar to those in FIG. 1, as an "A-coil" or V-shaped configuration.

FIG. 3 shows a somewhat schematic illustration wherein a complete heat exchanger, generally designated 60, includes a pair of stacks of plates 12 arranged in a V-configuration forming sort of an A-coil for the flowing liquid. The structure of the stacks of plates are similar to that described in relation to FIGS. 1 and 2, with a header 28 and appropriate liquid inlets and outlets at the top of each stack 12. In this embodiment, with the V-shaped orientation of the two stacks of plates, a common header 40' is provided at the bottom of the stacks of plates, i.e. at their "apex", and drain 46 is shown leading from lower header 40'. Of course, it is contemplated that additional V-configurations of stacks of plates or modules themselves could be stacked in a W-configuration and so on to enlarge the capacity of the heat exchanger.

Heat exchanger 60 in FIG. 3 includes a housing 62 having an air inlet 64 and an air outlet 66. Therefore, the air is caused to flow between the stacks 12 in the direction of arrows "H", perpendicularly through both stacks (similar to flow "E" in FIG. 1), and out of the housing in the direction of arrows "I" through outlet 66.

Figure 4:
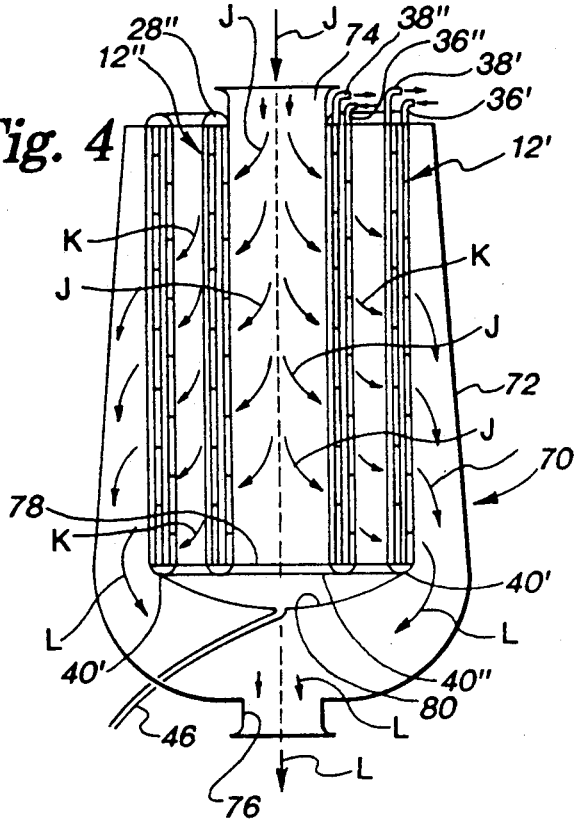
FIG. 4 is a further embodiment utilizing the stacks of plates in cylindrical configurations.

FIG. 4 shows a further modification of a heat exchanger, generally designated 70, including a housing 72 having an air inlet 74 and an air outlet 76. As with all of the embodiments, air can be forced through the housing by an appropriate fan.

In the embodiment of FIG. 4, the stacks of plates are shown somewhat schematically and generally designated 12' and 12''. The interior of the stacks are configured the same as stack 12 (FIGS. 1 and 2) except that the stacks are configured as concentric cylinders with cylindrical stack 12' surrounding and spaced from stack 12''. Again, headers 28' and 28'' are provided for the respective cylindrical stacks, with appropriate inlets 36' and 36'' and outlets 38' and 38'', respectively, for the liquid. Again, drain headers 40' and 40'' are provided for cylindrical stacks 12' and 12'', respectively. A separation or partition plate 78 may be provided at the bottom of the cylindrical stacks, and a drain pan 80 including a drain 46 can be provided, as described in relation to FIG. 1.

With the embodiment of FIG. 4, air is forced through inlet 74 toward the inside of cylindrical stack of plates 12'', as indicated by arrows "J". The air then flows through stack 12'' similar to the previous embodiments (i.e. "E" in FIG. 1) and then perpendicularly through the outer cylindrical stack 12' as indicated by arrows "K". The air then flows within housing 72 and out of the housing through outlet 76 as indicated by arrows "L". Both of the embodiments of FIGS. 3 and 4 illustrate that the use of the impingement orifice plate principle can be quite effective when using a gas, such as air, which has a poor coefficient of heat transfer, simply by expanding or "stacking" the stacks of orifice plate configurations. Since the "plumbing" of conventional heat exchangers which might use a gas as a medium is completely eliminated by the orifice plates, the efficiency, small size and lightweight advantages of the invention are apparent.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

I claim:

1. An impingement plate type heat exchanger for exchanging heat between a liquid and a gas, comprising a stack of plates with oppositely facing surfaces, said plates including impingement orifice plates, spacer plates, and manifold plates stacked surface to surface, the impingement orifice plates and the spacer plates cooperating to define first and second tortuous flow paths generally parallel to each other and perpendicularly through the plate for the liquid and the gas, respectively, the first flow path for the liquid being tortuous through orifices of the plates, and the stacked manifold plates, at least in part, defining flow passage means generally perpendicular to the first and second tortuous paths for distributing the liquid to the first tortuous flow path.

2. The impingement plate type heat exchanger of claim 1 wherein said manifold plates have channel means defining said flow passage means, the channel means extending generally parallel to the plates.

3. The impingement plate type heat exchanger of claim 2 wherein said channel means extend to and open at a peripheral edge of the manifold plates to provide inlet means for the liquid to the stack of plates.

4. The impingement plate type heat exchanger of claim 3 wherein said channel means extend to and open at at least one location spaced from the inlet means to provide outlet means for the liquid from the stack of plates.

5. An impingement plate type heat exchanger for exchanging heat between a liquid and a gas, comprising a stack of plates including impingement orifice plates, spacer plates, and manifold plates, the impingement orifice plates and the spacer plates cooperating to define first and second tortuous flow paths generally parallel to each other and perpendicularly through the plate for the liquid and the gas, respectively, the first flow path for the liquid being tortuous through orifices of the plates, and the manifold plates, at least in part, defining flow passage means for distributing the liquid to the first tortuous flow path, wherein said channel means extend to and open at at least one location spaced from the inlet means to provide outlet means for the liquid from the stack of plates, wherein said inlet means and outlet means are located along a common edge of the stack of plates, and including header means at said edge for directing liquid to and from the channel means.

6. The impingement plate type heat exchanger of claim 5, including drain means at an edge of the stack of plates remote from said common edge for draining liquid from the plates resulting from impingement of the gas against the plates.

7. The impingement plate type heat exchanger of claim 1 wherein said liquid is a coolant, and including drain means for draining condensate from the plates caused by cooling of the gas coming in contact therewith.

8. An impingement plate type heat exchanger for exchanging heat between a liquid and a gas, comprising a stack of plates with oppositely facing surfaces, said plates including manifold plates stacked surface to surface at opposite ends of the stack and impingement orifice plates and spacer plates at the center of the stack between the stacked manifold plates, the impingement orifice plates having a plurality of orifices formed therein and cooperating with the spacer plates to define first and second flow paths generally parallel to each other and perpendicularly through the plates for the liquid and the gas, respectively, the stacked manifold plates at one end of the stack, at least in part, defining flow passage means for distributing the liquid to the first flow path, and the stacked manifold plates at the opposite end of the stack defining flow passage means generally perpendicular to the first and second flow path defined by the stacked manifold plates and confined between the end plates for directing the liquid from the first tortuous flow path.

9. The impingement plate type heat exchanger of claim 8 wherein said manifold plates have channel means defining said flow passage means, the channel means extending generally parallel to the plates.

10. The impingement plate type heat exchanger of claim 9 wherein said channel means extend to and open at a peripheral edge of the manifold plates to provide inlet means for the liquid to the stack of plates.

11. The impingement plate type heat exchanger of claim 10 wherein said channel means extend to and open at at least one location spaced from the inlet means to provide outlet means for the liquid from the stack of plates.

12. The impingement plate type heat exchanger of claim 11 wherein said inlet means and outlet means are located along a common edge of the stack of plates, and including header means at said edge for directing liquid to and from the channel means.

13. The impingement plate type heat exchanger of claim 12, including drain means at an edge of the stack of plates remote from said common edge for draining liquid from the plates resulting from impingement of the gas against the plates.

14. The impingement plate type heat exchanger of claim 8 wherein said liquid is a coolant, and including drain means for draining condensate from the plates caused by cooling of the gas coming in contact therewith.

15. An impingement plate type heat exchanger for exchanging heat between a liquid and a gas, comprising at least a pair of stacks of plates with each stack including impingement orifice plates, spacer plates and manifold plates, the impingement orifice plates having a plurality of orifices formed therein and cooperating at least in part to define a first tortuous flow path generally perpendicularly through the plates for the liquid, the manifold plates at least in part defining flow passage means for distributing the liquid to the first tortuous flow path, means defining a second flow path through the plates for the air, and wherein the pair of stacks of plates are oriented in a V-configuration, with the means defining the second flow path for the air configured to direct the air through both stacks of plates.

16. The impingement plate type heat exchanger of claim 15 wherein said manifold plates have channel means defining said flow passage means, the channel means extending generally parallel to the plates of the respective stack.

17. The impingement plate type heat exchanger of claim 16 wherein said channel means extend to and open at a peripheral edge of the manifold plates to provide inlet means for the liquid to the stack of plates.

18. The impingement plate type heat exchanger of claim 17 wherein said channel means extend to and open at at least one location remote from the inlet means to provide outlet means for the liquid from the respective stack of plates.

19. The impingement plate type heat exchanger of claim 18 wherein said inlet means and outlet means are located along a common edge of the respective stack of plates, and including header means at said edge for directing liquid to and from the channel means.

20. The impingement plate type heat exchanger of claim 19, including drain means at an edge of the stacks of plates remote from said common edge for draining liquid from the plates resulting from impingement of the gas against the plates.

21. The impingement plate type heat exchanger of claim 15 wherein said liquid is a coolant, and including drain means for draining condensate from the plates caused by cooling of the gas coming in contact therewith.

22. An impingement plate type heat exchanger for exchanging heat between a liquid and a gas, comprising at least a pair of stacks of plates with each stack including impingement orifice plates, spacer plates and a plurality of manifold plates, the plurality of manifold plates being stacked surface to surface and each having oppositely facing surfaces, the plurality of impingement orifice plates being stacked surface to surface so as to at least in part define a first tortuous flow path generally perpendicularly through the plates for the liquid, the stacked manifold plates at least in part defining flow passage means for distributing the liquid to the first tortuous flow path, means defining a second flow path through the plates for the air, and wherein the pair of stacks of plates are configured as concentric cylinders, with the means defining the second flow path for the air configured to direct the air successively through both stacks of plates.

23. The impingement plate type heat exchanger of claim 22 wherein said manifold plates have channel means defining said flow passage means, the channel means extending generally parallel to the plates of the respective stack.

24. The impingement plate type heat exchanger of claim 23 wherein said channel means extend to and open at a peripheral edge of the manifold plates to provide inlet means for the liquid to the stack of plates.

25. The impingement plate type heat exchanger of claim 24 wherein said channel means extend to and open at at least one location remote from the inlet means to provide outlet means for the liquid from the respective stack of plates.

26. The impingement plate type heat exchanger of claim 25 wherein said inlet means and outlet means are located along a common edge of the respective stack of plates, and including header means at said edge for directing liquid to and from the channel means.

27. The impingement plate type heat exchanger of claim 26, including drain means at an edge of the stacks of plates remote from said common edge for draining liquid from the plates resulting from impingement of the gas against the plates.

28. The impingement plate type heat exchanger of claim 22 wherein said liquid is a coolant, and including drain means for draining condensate from the plates caused by cooling of the gas coming in contact therewith.

* * * * *